United States Patent [19]

Furuya et al.

[11] 4,168,164

[45] Sep. 18, 1979

[54] SCREEN PROCESS FOR FORMING ELECTROSTATIC LATENT IMAGES

[75] Inventors: Tutomu Furuya, Kawasaki; Shigeru Inowa, Hino, both of Japan

[73] Assignee: Konishiroku Photo Industry Co., Ltd., Tokyo, Japan

[21] Appl. No.: 811,605

[22] Filed: Jun. 30, 1977

[30] Foreign Application Priority Data

| | | | |
|---|---|---|---|
| Jul. 8, 1976 | [JP] | Japan | 51-80367 |
| Jul. 8, 1976 | [JP] | Japan | 51-80368 |
| Jul. 8, 1976 | [JP] | Japan | 51-80369 |

[51] Int. Cl.$^2$ ..... G03G 13/01

[52] U.S. Cl. ..... 96/1.2; 96/1 R; 355/3 SC; 355/4

[58] Field of Search ..... 96/1 R, 1.2; 355/3 SC, 355/4

[56] References Cited

U.S. PATENT DOCUMENTS

| | | | |
|---|---|---|---|
| 3,532,422 | 10/1970 | McFarlane | 96/1.2 |
| 3,680,954 | 8/1972 | Frank | 355/3 SC |
| 3,697,164 | 10/1972 | Pressman et al. | 355/4 |
| 3,713,734 | 1/1973 | Crane et al. | 96/1.2 X |
| 3,773,417 | 11/1973 | Pressman et al. | 96/1.2 X |
| 3,797,926 | 3/1974 | Fotland et al. | 355/3 SC |
| 3,809,557 | 5/1974 | Pressman et al. | 96/1.2 |
| 3,850,628 | 11/1974 | Pressman | 96/1.2 X |
| 3,884,686 | 5/1975 | Bean | 96/1.2 X |
| 3,910,789 | 10/1975 | Hastwell | 96/1.2 |
| 4,006,983 | 2/1977 | Pressman et al. | 355/4 |
| 4,090,876 | 5/1978 | Furuya et al. | 96/1 R |

*Primary Examiner*—Roland E. Martin, Jr.
*Attorney, Agent, or Firm*—James E. Nilles

[57] ABSTRACT

A process for forming electrostatic latent images to be developed by a color toner. The process comprises the steps of forming a first electrostatic image by charging a photoconductive layer formed on a first ion beam controlling screen, exposing the charged photoconductive layer imagewise to light based on a first image information, disposing a recording material having an insulating surface so that it confronts the exposed photoconductive layer and radiating ions on the insulating surface of the recording material through said first screen; and forming a corrected electrostatic latent image by charging a photoconductive layer formed on a second ion beam controlling screen, exposing the charged photoconductive layer of the second screen to light based on a second image information, disposing the recording material having the first electrostatic image formed thereon so that it confronts the exposed photoconductive layer of the second screen and radiating ions on the insulating surface of the recording material through said second screen. Each of the first and second ion beam controlling screen comprises a base composed of a metal lattice having numerous penetrating holes, a photoconductive layer formed on one surface of the base, an insulating layer formed on the other surface of the base, and a biasing conductive layer formed on the insulating layer.

6 Claims, 14 Drawing Figures

SCREEN PROCESS FOR FORMING ELECTROSTATIC LATENT IMAGES

The present invention relates to a process for forming electrostatic latent images. More particularly, the invention relates to a process for forming on a recording material an electrostatic latent image corresponding to an image information obtained by synthesizing a plurality of image informations.

In general, the subtractive color process is used in the color electrophotography. According to this subtractive color photographic process, a color original is separated into blue, green and red images by three color-separating filters, electrostatic latent images corresponding to the respective separated images are formed, the respective electrostatic latent images are developed by corresponding color toners, namely yellow, magenta and cyan toners, and a copied image reproducing the color original is obtained by superimposing substantially these three toner images.

However, since each of the toners fails to have ideal light-absorbing characteristics, only by superimposing the respective toner images a copied image reproducing the color original faithfully cannot be obtained. For example, when a color original 1 having a yellow area Y, a red area R and a magenta area M as shown in FIG. 1 is reproduced according to the subtractive color photography, the yellow area Y is reproduced by a yellow toner, the red area R is reproduced by yellow and magenta toners and the magenta area M is reproduced by a magenta toner. However, a blue light that must be absorbed only by the yellow toner is also absorbed by the magenta toner and therefore, a developed image area corresponding to the red area R becomes yellowish.

This disadvantage will be eliminated by subtracting the quantity $Q_2$ of the blue light absorbed by the applied magenta toner from the quantity $Q_1$ of the blue light absorbed by the yellow toner to be applied according to the separated blue image information and applying the yellow toner in a quantity corresponding to the above difference $(Q_1-Q_2)$. In order to accomplish this color correction simply, it is necessary to form an electrostatic latent image having the surface potential controlled according to this color correction, on a recording material which is to be developed by application of the yellow toner. More specifically, as shown in FIG. 2, the surface of a recording material 2 having a photoconductive layer is uniformly charged, for example, positively and it is then exposed to light through the blue separated image. After this treatment charges are left on areas corresponding to the yellow area Y and red area R shown in FIG. 1. In this case, it is necessary to form an electrostatic latent image in which the potential $V_1$ of the area corresponding to the red area R is lower than the potential $V_2$ of the area corresponding to the yellow area Y by the value d corresponding to the quantity of the magenta toner applied, namely the value d inversely proportional to the quantity of exposure through the green separated image, as shown in FIG. 3. In the drawing, the intensity of the potential is indicated by the density of distribution of symbols (+) and (−) for convenience's sake.

However, it is practically very difficult to obtain an electrostatic latent image in which two image informations are subtractively superimposed as shown in FIG. 3, though it is theoretically possible. For example, in order to obtain an electrostatic latent image in which a yellow toner image where the above-mentioned color correction has already been made is directly formed, it is theoretically sufficient to perform exposure of a blue separated image positive and exposure of a green separated image negative in the superimposed state after charging of a recording material, but practically, exposure of a negative is very difficult. Even if exposure of a negative is substantially attained by using the original as the negative or by conducting development according to the reversal process, since also exposure of the positive is necessary and a positive-negative relation must be established between the image of a mask used for exposure and the separated image to be exposed, reversal exposure is indispensable at any rate. It is very difficult to accomplish this reversal exposure according to ordinary optical means.

It is therefore a primary object of the present invention to provide a process in which an electrostatic latent image corresponding to subtractive superposition of a plurality of image informations can easily be formed.

Another object of the present invention is to provide a process in which an electrostatic latent image identical with one that is obtained by exposing two of three separated color images of a color original subtractively on one uniformly charged photoconductive layer and is therefore capable of providing a color-corrected copied image in development can be formed very easily.

Other objects, features and advantages of the present invention will be apparent from the detailed description made hereinafter by reference to the accompanying drawings, in which:

FIG. 1 is a view illustrating a color original;

FIGS. 2-A and 2-B are a view and graph illustrating diagrammatically the potential state of an electrostatic latent image free of a correction corresponding to the color correction, which corresponds to the original shown in FIG. 1;

FIGS. 3-A and 3-B are a view and graph illustrating the potential state of an electrostatic latent image including a correction corresponding to the color correction, which corresponds to the original shown in FIG. 1;

FIGS. 4-A and 4-B are views illustrating the principle of the operation of a screen that is used in the present invention;

A photoconductive screen for controlling ion beam, that is used in the present invention, will now be described.

Figure 4:
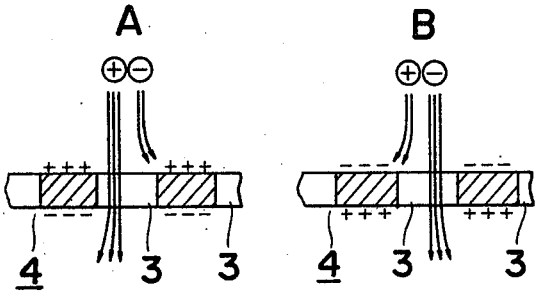

In general, as shown in FIG. 4-A, in the state where one face of a net member 4 having numerous penetrating holes 3 is positively charged and the other face of the net member 4 is negatively charged, a peripheral electric field is generated in the space surrounding each penetrating hole 3, and charged particles directed to pass through the penetrating hole 3 are influenced by the intensity and direction of this electric field. For example, when cations + are applied from the side of one face of this net member 4, the cations + pass through the penetrating holes 3 and arrive at the side of the other face, but anions − are attracted by positive charges on said one face and bonded thereto and they disappear and do not arrive at the side of the other face. In contrast, when cations + are applied from the side of the other face of the net member 4, as shown in FIG. 4-B, they are intercepted, but anions − are allowed to pass through the net member 4. The quantity of ions passing through the net member 4 is changed depending on the intensity of said peripheral electric field, namely the quantities of charges on both the faces of the net member 4 and the intensity of the electric field for accelerating ions to pass through the penetrating holes 3.

Figure 5:
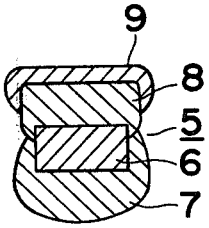
FIG. 5 is a sectional view showing an example of the screen that can be used in the first and second embodiments of the present invention.

The screen that is used in the present invention is to control ion beam based on the above principle, and an example of the screen that is preferably used in the first embodiment of the present invention is illustrated in FIG. 5. This screen 5 comprises a photoconductive layer 7 formed on one face of a base 6 composed of a metal lattice having numerous penetrating holes, and an insulating layer 8 is formed on the other surface of the base 6 and a biasing conductive layer 9 is formed on the insulating layer 8.

As the ion beam controlling screen 5 which is used in the first and second embodiments has a particular structure described above, it is possible to form an electrostatic image on the photoconductive layer 7 of the screen 5 with the easily practicable steps. A preferred electrostatic image can be formed by controlling the biasing voltage applied on the biasing conductive layer 9 of the screen 5, and therefore, the quantity of the ions passing through the screen can be controlled precisely corresponding to the original.

In this first embodiment and subsequent embodiments, formation of an electrostatic latent image including a color correction to be developed by a yellow toner is illustrated as an example.

In the first embodiment of the present invention a screen 5 having a structure as shown in FIG. 5 is employed, and the photoconductive layer 7 of the screen 5 is uniformly charged negatively and an image of a color original is projected onto the charged photoconductive layer 7 through a blue filter, whereby a positive electrostatic latent image corresponding to the blue separated image is formed by negative charges. An ion source 10 is then disposed to confront the biasing conductive layer of the screen 5, and a recording material 13 comprising an insulating surface layer 12 formed on a conductor 11 is disposed so that the insulating surface layer 12 confronts the photoconductive layer 7 of the screen 5. A negative bias voltage is applied to the biasing conductive layer 9 from a power source 14, and in the state where the conductor 11 of the recording material 13 is maintained at a negative potential lower than that of the base 6 of the screen 5 by a power source 15, the ion beam from the ion source 10 is actuated by a power source 16 and the ion source 10 is scanned while radiating cations 17 toward the screen 5. Thus, a positive image is formed on the photoconductive layer 7 of the screen 5 by negative charges, and further, since the quantity of the cations 17 passing through a specific area of the screen 5 is increased or decreased with increase or decrease of the quantity of negative charges on the photoconductive layer at said specific area as pointed out hereinbefore, a positive electrostatic latent image of positive charges corresponding to the blue separated image is formed on the insulating surface layer 12 of the recording material 13 by the cations 17 which have passed through the screen 5.

Needless to say, the so obtained electrostatic image is free of a correction corresponding to the color correction. In other words, the so formed electrostatic latent image has a potential state as shown in FIG. 6.

Figure 3:
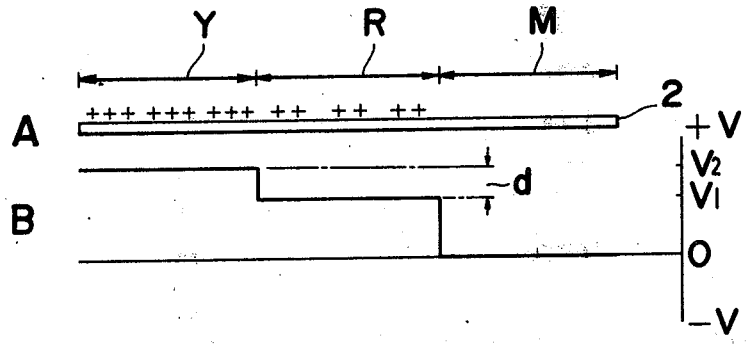
Figure 6:
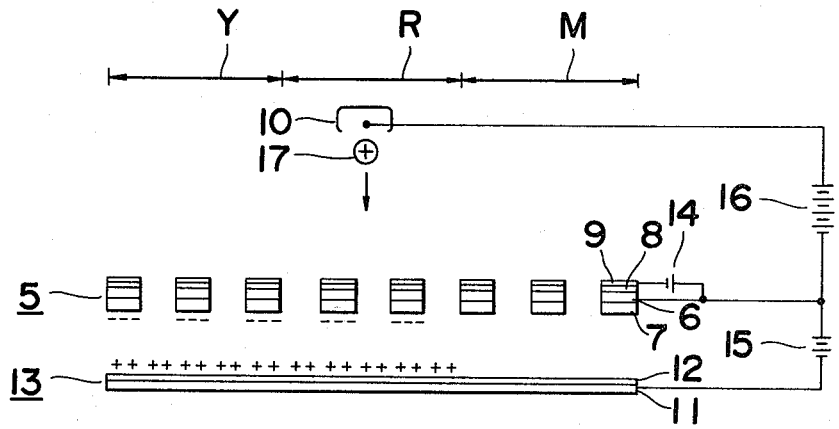
FIGS. 6 and 7 are diagrams illustrating the first embodiment of the present invention.
Figure 7:
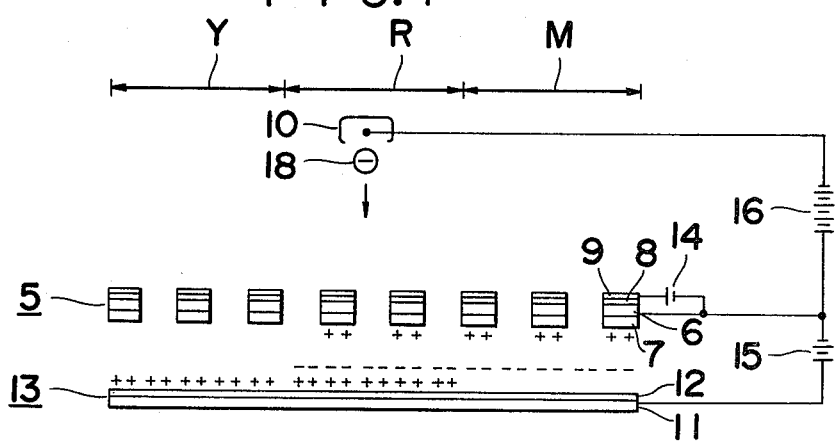
Figure 8:
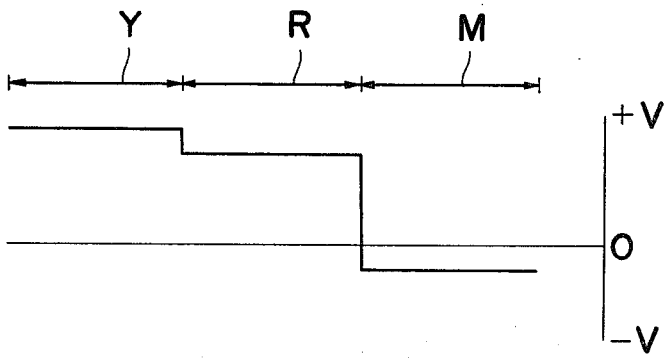
FIG. 8 is a graph illustrating the potential state of an electrostatic latent image obtained in the first embodiment of the present invention.

Then, as shown in FIG. 7, the entire surface of the photoconductive layer 7 of the screen 5 is uniformaly charged again to a positive potential, the green separated image of the color original is exposed to form a positive image of positive charges on the photoconductive layer, and the ion source 10 and the recording material 13 having the electrostatic latent image formed thereon are disposed to the screen in the same manner as shown in FIG. 6 and a positive bias boltage is applied to the biasing conductive layer 9 of the screen 5. Further, in the state where the conductor 11 of the recording material 13 is maintained at a positive potential higher than that of the base 6, the ion beam from the ion source 10 is scanned while radiating anions 18 toward the screen 5. If no electrostatic latent image has been formed on the insulating surface layer 12 of the recording material 13, a positive image corresponding to the green separated image, namely an electrostatic image to be developed by the magenta toner, will be formed by negative charges. However, since a positive latent image of positive charges corresponding to the blue separated image has already been formed on the insulating surface layer 12, an electrostatic latent image corresponding to superposition of the foregoing two electrostatic latent images is formed on the insulating surface layer 12 of the recording material 13. Further, since both the electrostatic latent images are different from each other with respect to the charge polarity, the above superposition of the two images is performed subtractively and a potential distribution pattern as shown in FIG. 8 is formed. Accordingly, in the so obtained electrostatic latent image, the potential of the area to which the yellow toner is to be applied is subtracted in correspondence to the potential of the area to which the magenta toner is to be applied, and when a bias voltage is applied at the development step, and electrostatic image having a potential distribution as shown in FIG. 3 is obtained, and when this latent image is developed with the yellow toner, there can be obtained a yellow toner image in which the blue light absorbed by the magenta toner is corrected.

In the foregoing embodiment, cations may be radiated from the ion source 10 instead of the anions 18. In this case, the radiated cations pass through the screen 5 in a quantity determined by the quantity of the charges forming an electrostatic image on the photoconductive layer 7 of the screen 5, and as a result, an electrostatic latent image consisting of superposition of a positive image of positive charges corresponding to the blue separated image and a negative image of positive charges corresponding to the green separated image is obtained on the insulating surface layer 12 of the recording material 13. Also this electrostatic latent image has a potential distribution pattern similar to that of the electrostatic latent image obtained according to the above-mentioned method, though the potential level is different between the two electrostatic latent images, and a yellow toner image in which the color correction has been made can similarly be obtained.

As will readily be understood from the foregoing illustration, when a first image and a second image are superimposed subtractively, positive and negative images of the same polarity, positive images different in the polarity or negative images differing in the polarity are combined. In the present invention, as in the foregoing embodiment, this superposition of the above combined images can be accomplished very simply without performing reversal exposure.

More specifically, in the present invention, the polarity of charges of the electrostatic image formed on the photoconductor layer 7 of the screen 5 is the same as the charging polarity before the exposure, and when radiated ions are of the same polarity as that the electrostatic image, a negative electrostatic latent image is formed on the recording material 13 and when the radiated ions are of the opposite polarity, a positive electrostatic latent image is formed on the recording material 13. If, in connection with the electrostatic image corresponding to the image X, positive and negative images of positive charges are represented as $X^+$ and $\overline{X}^+$, respectively, and positive and negative images of negative charges are represented as $X^-$ and $\overline{X}^-$, respectively, the state of the electrostatic image corresponding to the second image II, which is combined with various electrostatic images $I^+$, $I^-$, $\overline{I}^+$ and $\overline{I}^-$ corresponding to the first image I formed on the recording material, the charge polarity of the photoconductive layer 7 of the screen 5 necessary for obtaining the electrostatic image in said state and the kind of ions to be irradiated for obtaining the electrostatic image in said state are as shown in the following table.

Table

| Electrostatic Image Corres-Ponding to First Image | Combination | Polarity of Photo-conductive Layer | Kind of Ions |
|---|---|---|---|
| $I^+$ | $I^+$, $\overline{II}^+$ | positive | cations |
| $I^+$ | $I^+$, $II^-$ | positive | anions |
| $I^-$ | $I^-$, $II^+$ | negative | cations |
| $I^-$ | $I^-$, $\overline{II}^-$ | negative | anions |
| $I^+$ | $\overline{I}^+$, $II^+$ | negative | cations |
| $I^+$ | $\overline{I}^+$, $\overline{II}^-$ | negative | anions |
| $I^-$ | $\overline{I}^-$, $\overline{II}^+$ | positive | cations |
| $I^-$ | $\overline{I}^-$, $II^-$ | positive | anions |

As will be apparent from the above table, if the electrostatic image corresponding to the first image is $I^+$ or $\overline{I}^-$, the photoconductive layer 7 of the screen 5 is positively charged so as to form an electrostatic image corresponding to the second image II, and when the electrostatic image corresponding to the first image is $I^-$ or $\overline{I}^+$, the photoconductive layer 7 of the screen 5 is negatively. If exposure is then conducted, an electrostatic latent image consisting of the intended combination of the two superimposed electrostatic images can be obtained irrespective of whether the radiated ions are cations or anions. In the present invention, it is only important to attain the above-mentioned combination of electrostatic images, and it is not critical which of the two electrostatic images should be first formed on the recording material. In the present invention, of course, two different screens may be used for forming an electrostatic image corresponding to the first image I and an electrostatic image corresponding to the second image II, respectively.

The second embodiment of the present invention will now be described.

Figure 1:
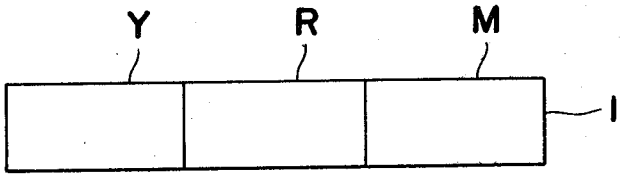
Figure 2:
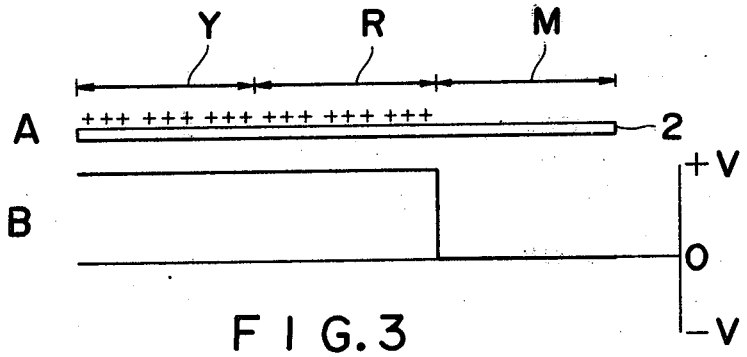
Figure 9:
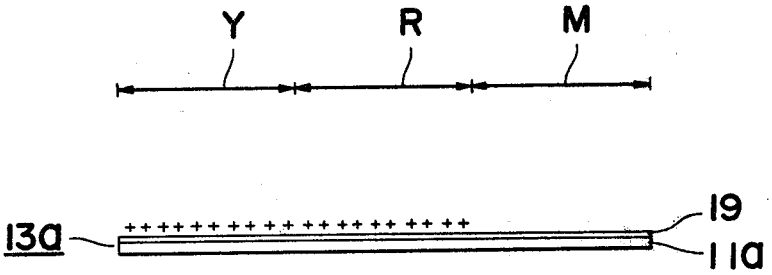
FIGS. 9 and 10 are diagrams illustrating the second embodiment of the present invention.

In the second embodiment of the present invention, a screen 5 having a structure as shown in FIG. 5 is used as in the above-mentioned first embodiment. As shown in FIG. 9, a recording material 13*a* comprises a conductor 11*a* and a photoconductive surface layer 19 formed on the conductor 11*a*. The photoconductive surface layer 19 is uniformly charged positively, and an image of a color original is projected through a blue filter on the charged photoconductive surface layer 19 to thereby form a positive electrostatic image of positive charges corresponding to a blue separated image. This electrostatic latent image, of course, is free of a correction corresponding to the color correction. Namely, it has a potential state as shown in FIG. 2.

Figure 10:
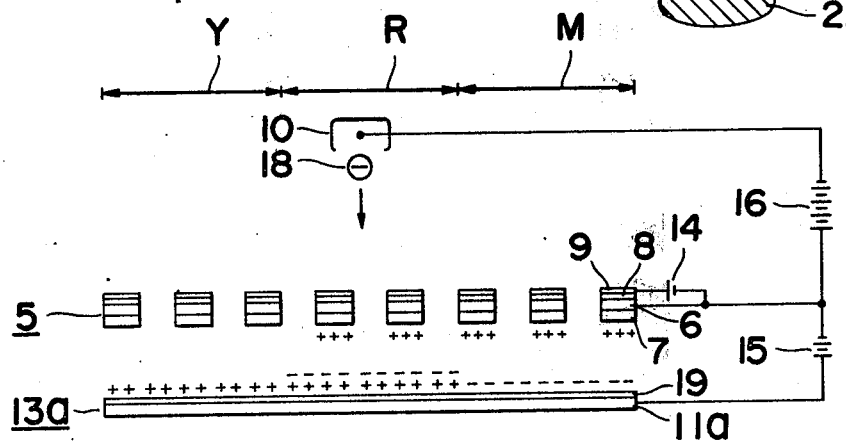

Then, as shown in FIG. 10, the photoconductive layer 7 of the screen 5 is uniformly charged positively, and the image of the color original is projected to the charged photoconductive layer 7 through a green filter, whereby a positive electrostatic image of positive charges corresponding the green separated image is formed. Then, an ion source 10 is disposed so that it confronts a biasing conductive layer 9 of the screen 5, and the recording material 13*a* is disposed so that the photoconductive surface layer 19 of the recording material 13*a* confronts the photoconductive layer 7 of the screen 5. In this state, a positive bias voltage is applied to the biasing conductive layer 9 from a pwer source 14, and in the state where a conductor 11*a* of the recording material 13*a* is maintained at a positive potential higher than that of the base 6 of the screen 5 by a power source 15, the ion source 10 is actuated by a power source 16 and the ion beam is scanned while radiating anions 18 toward the screen 5. Since a positive image of positive charges is thus formed on the photoconductive layer 7 of the screen 5 and the quantity of passing anions at a specific area of the screen 5 is changed depending on the quantity of positive charges on the photoconductive layer 7, if no electrostatic image has been formed on the photoconductive surface layer 19 of the recording material 13*a*, a positive image of negative charges corresponding to the green separated image, namely an electrostatic image to be developed by the magenta toner, will be formed on the photoconductive surface layer 19 of the recording material 13*a*. However, since a positive image of positive charges corresponding to the blue separated image has been formed on the photoconductive surface layer 19 as pointed out hereinbefore, the two electrostatic images are overlapped and superposed to form one electrostatic latent image. Since the two electrostatic images are different in the polarity, the above superposition is accomplished subtractively and the resulting electrostatic latent image has the same potential distribution pattern as shown in FIG. 3.

Accordingly, in the so obtained electrostatic latent image, the potential of the area to which the yellow toner is to be applied is subtracted in the portion to which the magenta toner is to be applied, and when this electrostatic latent image is developed by the yellow toner, there is obtained a yellow toner image in which the blue light to be absorbed by the magenta toner is corrected.

As will be apparent from the foregoing illustration, also in the second embodiment of the present invention, the above-mentioned two electrostatic latent images can easily be combined very simply without performing reversal exposure.

More specifically, a positive electrostatic image $I^+$ of positive charges or positive electrostatic image $I^-$ of negative charges corresponding to the first image I can easily be formed by exposure on the photoconductive surface layer 19 of the recording material 13*a*. The electrostatic image corresponding to the second image II, which is to be combined with the electrostatic image $I^+$, is a negative image $\overline{II}^+$ of positive charges or a positive image $II^-$ of negative charges, and the electrostatic image corresponding to the second image II, which is combined with the electrostatic image $I^-$, is a negative image $\overline{II}^-$ of negative charges or a positive image $II^+$ of positive charges. Thus, an electrostatic image corresponding to the second image II is formed by radiating ions through the screen 5, and further, if the polarity of the electrostatic image formed on the photoconductive layer 7 of the screen 5, namely the charging polarity of the photoconductive layer 7 before exposure, is the same as the polarity of ions radiated from the ion source 10, an image negative to the electrostatic image on the photoconductive layer 7 is formed on the photoconductive surface layer 19 of the recording material 13*a* and if the above two polarities are opposite to each other, an image positive to the electrostatic image on the photoconductive layer 7 is formed on the photoconductive surface layer 19 of the recording material 13*a*. Therefore, when the electrostatic image first formed on the photoconductive surface layer is $I^+$, if the photoconductive layer 7 of the screen 5 is positively charged and exposure is conducted, $\overline{II}^+$ is formed by cations or $II^-$ is formed by anions. When the above electrostatic image is $I^-$, if the photoconductive layer 7 is positively charged, $II^+$ or $\overline{II}^-$ is formed. In short, if only the photoconductive layer 7 is charged with the same polarity as that of the electrostatic image corresponding to the first image, an electrostatic latent image consisting of subtractive superposition of the two electrostatic images can easily be formed according to customary procedures.

Figure 11:
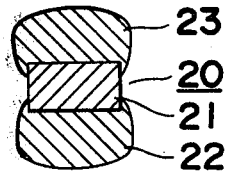
FIG. 11 is a sectional view showing an example of the screen that can be used in the third and fourth embodiments of the present invention.

In the third embodiment of the present invention, a screen 20 having a structure as shown in FIG. 11 is used. The screen 20 comprises a base 21 composed of a metal lattice having numerous penetrating holes, a first photoconductive layer 22 formed on one face of the base 21 and a second photoconductive layer 23 disposed on the other face of the base 21 separately from the first conductive layer 22. As the ion controlling screen 20 which is used in the third and fourth embodiments has a particular structure described above, it is possible to form an electrostatic emage on the photoconductive layer 7 of the screen with the easily practicable steps.

Figure 12:
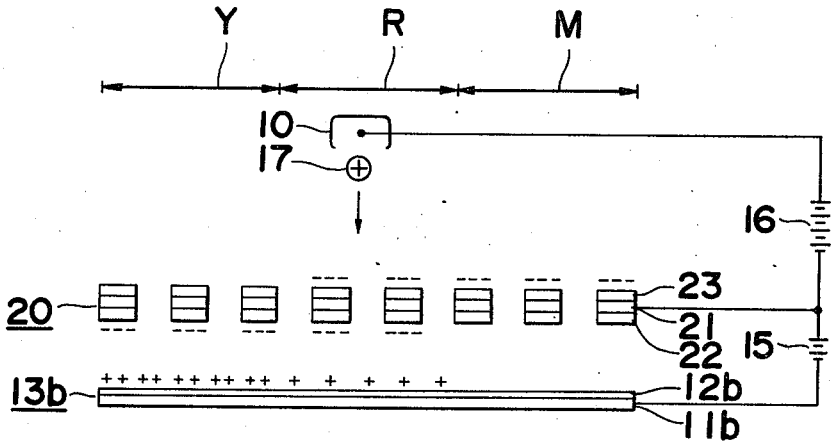
FIG. 12 is a diagram illustrating the third embodiment of the present invention.

Both the first and second photoconductive layers 22 and 23 of the screen 20 are uniformly charged negatively as shown in FIG. 12, and an image of a color original is projected through a blue filter onto the first photoconductive layer 22 to form a positive electrostatic image of negative charges corresponding to the blue separated image. The image of the color original is projected through a green filter onto the second photoconductive layer 23 to form a positive electrostatic image of negative charges corresponding to the green separated image, so that an image-mirror relation is established between said electrostatic image corresponding to the green separated image and said electrostatic image corresponding to the blue separated image. Then, an ion source 10 is disposed so that it confronts the second photoconductive layer 23 of the screen 20 and a recording material 13*b* comprising a conductor 11*b* and an insulating surface layer 12*b* formed on the conductor 11*b* is disposed so that the recording material 13*b* confronts the first photoconductive layer 22. In the state where the conductor 11*b* of the recording material 13*b* is maintained at a potential lower than that of the base 21 of the screen 20 by a power source 15, the ion source 10 is actuated by a power source 16 and the ion beam is scanned while radiating cations 17 from the ion source 10.

Thus, the intended electrostatic latent image is formed on the insulating surface layer 12*b* of the recording material 13*b*. If no electrostatic image has been formed on the second photoconductive layer 23, the cations 17 will pass through the screen 20 in a quantity varying proportionally to the quantity of charges of the electrostatic image formed on the first photoconductive layer and a positive electrostatic image of positive charges corresponding to the blue separated image will be formed on the insulating surface layer 12*b* of the recording material 13*b*. Further, if no electrostatic image has been formed on the first photoconductive layer 22, the cations 17 will pass through the screen 20 in a quantity varying in reverse proportion to the quantity of charges of the electrostatic latent image on the second photoconductive layer 23 and a negative electrostatic latent image of positive charges corresponding to the green separated image will be formed on the insulating surface layer 12*b* of the recording material 13*b*. However, in practice, since the foregoing two electrostatic images are simultaneously formed, the cations 17 are allowed to free pass at the area corresponding to the yellow area Y of the color original and the cations 17 is caused to pass in a controlled manner at the area corresponding to the red area R of the color original. Further, passage of the cations 17 is intercepted at the area corresponding to the magenta area M of the color original. Accordingly, an electrostatic latent image having a potential state as shown in FIG. 3 is formed.

When the so formed electrostatic latent image is developed by the yellow toner, there can be obtained a yellow toner image in which the blue light to be absorbed by the magenta toner is corrected.

Figure 13:
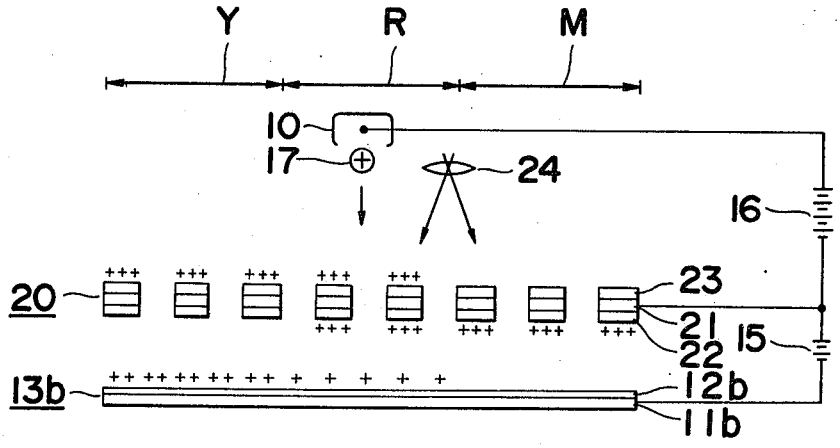
FIG. 13 is a diagram illustrating the fourth embodiment of the present invention.

In the fourth embodiment of the present invention, a screen having a structure as shown in FIG. 11 is used. As shown in FIG. 13, an electrostatic mirror image of positive charges corresponding to the green separated image of a color original is formed on a first photoconductive layer 22 of the screen 20. As in the third embodiment, a recording material 13*b* is disposed so that it confronts this first photoconductive layer 22, and an ion source 10 and an exposure mechanism 24 are disposed so that they confront a second photoconductive layer 23 of the screen 20. While an image of the color original is projected through a blue filter onto the second photoconductive layer 23 of the screen 20 by means of the exposure mechanism 24, as in the third embodiment the ion source 10 is scanned while radiating cations 17.

By this exposure treatment, the second photoconductive layer 23 of the screen 20 is charged under irradiation with the cations 17 from the ion source 10 and is simultaneously exposed to light of the blue separated image. Accordingly, an electrostatic image of positive charges corresponding to the blue separated image is formed on the second photoconductive layer 23. Therefore, as in the above-mentioned third embodiment, on the insulating surface layer **12*b* of the recording material 13*b*** there is formed an electrostatic latent image consisting of superposition of an electrostatic image of positive charges corresponding to the green separated image and a positive elctrostatic image of positive charges corresponding to the green separated image.

Figure 14:
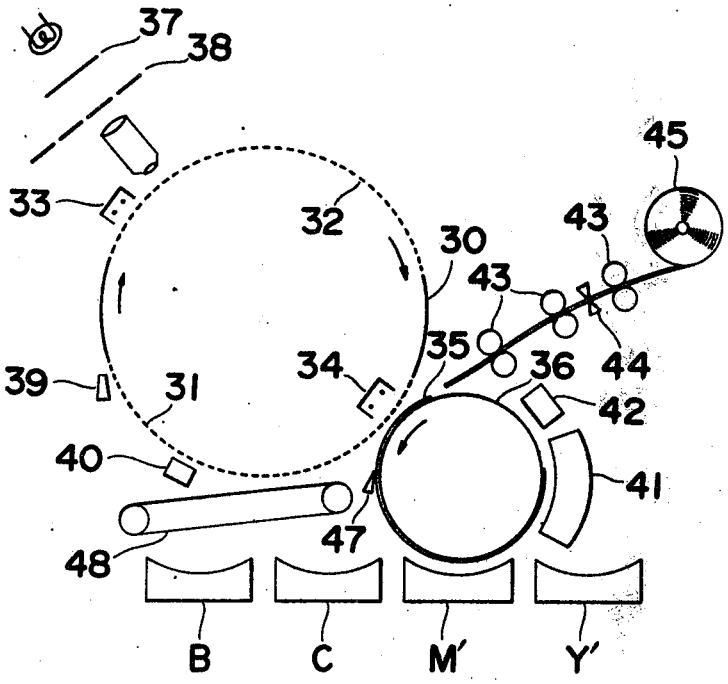
FIG. 14 is a schematic view showing an embodiment of a copying machine for forming a copied image reproducing a color original by the method disclosed in said first embodiment.

FIG. 14 is a schematic view showing an embodiment of a copying machine for forming a copied image reproducing a color original by the method disclosed in said first embodiment.

In said copying machine, a screen 31 having a photosensitive layer of Se and a screen 32 having a photosensitive layer of CdS are provided separately with each other so as to form parts of rotary drum 30. Positive voltage is applied on a biasing conductive layer of the screen 31 when the photosensitive layer of Se of said screen 31 is charged positively by a charger 33. Thereafter, a green separated image of a color original 37 is exposed through a green filter selected from a filter group 38 on said screen 31, so that an electrostatic latent image of positive charges corresponding to said separated image is formed on said screen 31. Then, the drum 30 is rotated in the clockwise direction and anions are applied by using a charger 34 through the screen 31 on a recording material 35 supported on an electroconductive drum 36, while applying positive voltage of suitable value on said biasing conductive layer of the screen 31, so that a first electrostatic latent image of negative charges is formed on said recording material 35. It is necessary to maintain the potential of the electroconductive drum 36 higher than that of a base of said screen 31 when ions are applied.

At the same time of the formation of said first electrostatic latent image of negative charges on the recording material 35, negative charge is applied on the photosensitive layer of CdS of the screen 32 by using the charger 33, while applying negative voltage on the biasing conductive layer of the screen 32 and a red separated image of the color original 37 is exposed through a red filter selected from the filter group 38 on the screen 32, so that an electrostatic latent image of negative charges corresponding to said separated image is formed on said screen 32. Thereafter, the drum 30 is rotated in the clockwise direction and cations are applied by using the charger 34 through the screen 32 on the recording material 35 when the screen 32 is passed through the underside of the charger 34, so that a second electrostatic latent image of positive charges corresponding to said red separated image is formed on said recording material 35 such that the second electrostatic latent image is superimposed on the first electrostatic latent image and the images are subtracted from each other.

When cations are applied, negative voltage is applied on the biasing conductive layer of the screen 32 and a voltage is applied on the electroconductive drum 36 so that the potential of the drum 36 becomes lower than that of a base of the screen 32.

Thus, the electrostatic latent image corresponding to the green separated image, in which the green light absorbing characteristic of the cyan toner is corrected is formed on the recording material 35.

This electrostatic latent image is then developed by a magenta toner developer M′ in a liquid developer 46 and dried by a dryer 41. A residual electrostatic latent image is discharged by a discharger 42 and an ideal visible image of magenta toner is formed on the recording material 35.

An ideal separated visible image of cyan toner can easily be obtained in the same manner.

In FIG. 14, reference numeral 39 denotes an air nozzle for cleaning, 40 a discharger, 43 pairs of recording paper feeding rollers, 44 a paper cutter, 45 a roll of recording paper, 47 separating projections, 48 a conveyor belt for conveying a copied paper, Y′ a yellow toner developer, C a cyan toner developer, and B a black toner developer.

As will be apparent from the foregoing detailed description, according to the process of the present invention for forming electrostatic latent images, it is possible to form very simply and easily on a recording material an electrostatic latent image in which two electrostatic images are subtractively overlapped and superposed, and when the process of the present invention is applied to the color electrophotography, an electrostatic latent image in which the color correction is precisely accomplished can be obtained very easily and simply. Accordingly, according to the present invention, it is possible to easily obtain a color copy in which an original is faithfully reproduced with precise color correction. Therefore, the present invention attains various advantages and makes great contributions to the art.

What is claimed is:

1. A process for forming color electrographs comprising the steps of forming a first electrostatic latent image by charging a photoconductive layer formed on a recording material and exposing the charged photoconductive layer imagewise to light based on one color separated image information of a color original; forming a corrected electrostatic latent image by charging a photoconductive layer formed on an ion beam controlling screen with the same polarity as the polarity of charges constituting said first electrostatic image, exposing the charged photoconductive layer imagewise to light based on another information of said color separated image informations, disposing the recording material having the first electrostatic image formed thereon so that it confronts the exposed photoconductive layer of said screen and radiating ions to the photoconductive layer of the recording material through said screen; and developing the so formed electrostatic latent image by a toner corresponding to said one information of the color separated image informations, said ion beam controlling screen comprising a base composed of a metal lattice having numerous penetrating holes, a photoconductive layer formed on one surface of the base, an insulating layer formed on the other surface of the base, and a biasing conductive layer formed on the insulating layer.

2. A process for forming color electrographs comprising charging with the same polarity both photoconductive layers of an ion beam controlling screen having two photoconductive layers on both the surfaces thereof, respectively, exposing the charged photoconductive layers based on one and another informations of color separated image informations of a color original, respectively, disposing a recording material so that it confronts said exposed screen, radiating ions to the recording material through said screen to form an electrostatic latent image consisting of superposed positive and negative images corresponding to said one and another informations of the color separated image informations, respectively, and developing the so formed electrostatic latent image by a toner corresponding to said one information of the color separated image informations.

3. A process for forming color electrographs comprising forming an electrostatic latent image on one photoconductive layer of an ion beam controlling screen having two photoconductive layers formed on both the surfaces thereof, respectively, based on one of three color separated image informations of a color original, disposing a recording material so that it confronts said one photoconductive layer of the screen, radiating ions providing the same polarity as that of charges constituting said electrostatic image to said recording material through said screen simultaneously exposing the other photoconductive layer of said screen imagewise to light based on another information of the three color separated image informations of said color original to form an electrostatic latent image, and developing the so formed electrostatic latent image by a toner corresponding to said another color separated image informations.

4. A process for forming electrostatic latent images comprising the steps of forming a first electrostatic latent image by charging a photoconductive layer formed on a recording material and exposing the charged photoconductive layer imagewise to light based on a first image information; and forming a corrected electrostatic latent image by charging a photoconductive layer formed on an ion beam controlling screen with the same polarity as that of the polarity of charges constituting said first electrostatic image, exposing the charged photoconductive layer imagewise to light based on a second image information, disposing the recording material having the first electrostatic image formed thereon so that it confronts the exposed photoconductive layer of said screen and radiating ions to the photoconductive layer of the recording material through said screen, said ion beam controlling screen comprising a base composed of a metal lattice having numerous penetrating holes, a photoconductive layer formed on one surface of the base, an insulating layer formed on the other surface of the base, and a biasing conductive layer formed on the insulating layer, said first and second image informations being color separated images of one color image.

5. A process for forming electrostatic latent images comprising charging with the same polarity both photoconductive layers of an ion beam controlling screen having two photoconductive layers on both the surfaces thereof, respectively, exposing the charged photoconductive layers based on first and second image informations, respectively, disposing a recording material so that it confronts said exposed screen, and radiating ions to the recording material through said screen to form an electrostatic latent image consisting of superposed positive and negative images corresponding to said first and second image informations, respectively, said first and second image informations being color separated images of one color image between which a mirror-image relation is established.

6. A process for forming electrostatic latent images comprising forming an electrostatic latent image on one photoconductive layer of an ion beam controlling screen having two photoconductive layers formed on both the surfaces thereof, respectively, based on a first image information, disposing a recording material so that it confronts said one photoconductive layer of the screen, radiating ions providing the same polarity as that of charges constituting said electrostatic image to said recording material through said screen and simultaneously exposing the other photoconductive layer of said screen imagewise to light based on a second image information to form an electrostatic latent image, said first and second image information being color separated images of one color image between which a mirror-image relation is established.

* * * * *